US007535352B2

(12) United States Patent
Sobol

(10) Patent No.: US 7,535,352 B2
(45) **Date of Patent: *May 19, 2009**

(54) PORTABLE INSTANTANEOUS WIRELESS EVENT BASED PHOTO IDENTIFICATION AND ALERTING SECURITY SYSTEM

(75) Inventor: Raymond J. Sobol, Calgary (CA)

(73) Assignee: EvidencePix Inc. (CA)

( * ) Notice: Subject to any disclaimer, the term of this patent is extended or adjusted under 35 U.S.C. 154(b) by 0 days.

This patent is subject to a terminal disclaimer.

(21) Appl. No.: 11/565,399

(22) Filed: Nov. 30, 2006

(65) Prior Publication Data

US 2007/0090948 A1 Apr. 26, 2007

Related U.S. Application Data

(63) Continuation of application No. 10/638,379, filed on Aug. 12, 2003, now Pat. No. 7,161,479.

(60) Provisional application No. 60/402,579, filed on Aug. 12, 2002.

(51) Int. Cl.
*G08B 13/00* (2006.01)

(52) U.S. Cl. ..... 340/541; 340/506; 340/691.5; 340/539.25; 348/143

(58) Field of Classification Search ..... 340/426.1, 340/425.5, 691.5, 541, 500, 531, 539.25, 340/517, 521, 539.1, 506; 348/143; 379/88.14, 379/88.16, 88.22

See application file for complete search history.

(56) References Cited

U.S. PATENT DOCUMENTS 5,027,104 A 6/1991 Reid
5,546,072 A * 8/1996 Creuseremee et al. ..... 340/574
5,926,209 A * 7/1999 Glatt ..... 348/143
6,002,326 A * 12/1999 Turner ..... 340/426.1
6,433,683 B1 8/2002 Robinson
6,504,571 B1 1/2003 Narayanaswami et al.
6,741,165 B1 5/2004 Langfahl et al.
6,748,055 B1 * 6/2004 Borman et al. ..... 379/88.14
6,975,220 B1 12/2005 Foodman et al.
7,161,479 B2 * 1/2007 Sobol ..... 340/506

* cited by examiner

*Primary Examiner*—Anh V La
(74) *Attorney, Agent, or Firm*—Fliesler Meyer LLP

(57) ABSTRACT

A portable instantaneous wireless event based photo identification and alerting security system ideally suited for mobile protection of property, spaces and people, and for protection in motor vehicles, residences, businesses and other commercial locations, either as a stand alone system or as an addition in whole or in part to existing security systems when an intruder enters into personal spaces, detection devices determine the intruder's presence and digital photographs are immediately taken, and securely transmitted to pre-determined recipients that may include an owner-operator, apprehending authorities or others. Time and date are annotated to these photographs. Furthermore, an audio message is sent to the owner-operator, apprehending authorities or others that the intrusion is occurring, also annotating this information with time and date, thus enabling an opportunity to respond immediately to the intrusion. If desired, a local audio message at the intrusion location may announce to the intruder that detection has been made and or that photographs have already been taken and securely transmitted.

14 Claims, 1 Drawing Sheet

PORTABLE INSTANTANEOUS WIRELESS EVENT BASED PHOTO IDENTIFICATION AND ALERTING SECURITY SYSTEM

CLAIM OF PRIORITY

This application is a continuation of U.S. patent application Ser. No. 10/638,379, filed Aug. 12, 2003, which claims the benefits of U.S. Provisional Patent Application No. 60/402,579 filed Aug. 12, 2002, of which the complete disclosures are incorporated fully herein by reference.

FIELD OF THE INVENTION

The present invention pertains to a security system. Specifically, the present invention pertains to a portable instantaneous wireless event based photo identification and alerting system of unwanted intruders into personal spaces.

BACKGROUND OF THE INVENTION

Security systems are used to secure, protect and safeguard property, spaces and people from unwanted intrusions; theft, vandalism and other mischief. Effective security systems include guards, trained dogs, electronic intrusion detection, video surveillance, photo surveillance, formidable barriers and counter-offensive devices.

Video surveillance systems in particular are effective and are in widespread use. In general they record information at all times and in doing so, capture physical description information about intruders that may be useful in identifying, apprehending and convicting them. Video surveillance systems can also transmit this information to others via wire-based and wireless technology, and across the Internet.

However, video surveillance systems require owner-operators to review the media in order to locate the relevant sequences that provides physical description information about intruders. This review process requires diligent time commitment on the part of the owner-operator, and results in some delay in obtaining physical description information.

Photo surveillance in either analog or digital format is seldom effectively used to photograph intruders due to the inefficiencies associated with retrieving, processing and dissemination of photographs to interested parties, where automated photography systems are employed.

The dissemination of an intruder's physical description information to apprehending authorities or other involved groups must ideally follow in an urgent and timely manner in order to increase the opportunity of an intruder's apprehension. However limitations such as compatibility of equipment, available bandwidth, and portability among apprehending authorities or other involved groups hinders the effectiveness of wireless and Internet technology for video surveillance systems.

Furthermore, the direct communication of an intruder's physical description information to apprehending authorities or other involved groups is open to mischievous manipulation and mal intent whereby an innocent person's physical description may be edited into un-securely transmitted media.

Increasingly, the need to secure, protect and safeguard property, spaces and people from unwanted intrusions, theft, vandalism and other mischief , in a mobile capacity is desirable. Video surveillance and photo detection systems do not conveniently lend themselves to desired portability.

It is therefore desirable and an improvement in the art for a portable security system incorporating devices to instantly detect an intruder, to digitally photograph an intruder, to compress the digital photo(s) to a relatively small file size, to transmit these compressed digital photos via a wireless network to a central control center across a secure mode, and to securely store the original digital photo(s) prior to immediately forwarding copies to apprehending authorities or other involved groups.

SUMMARY OF THE INVENTION

The portable instantaneous wireless event based photo identification and alerting system of unwanted intruders into personal spaces, includes a means for detecting intruders, an electronic control unit, a digital camera, a wireless telephone module with email mufti-media messaging service enabled.

Upon detection of an intruder by means of motion and or sound detectors and or electrical contacts disturbance, the electronic control unit commands the digital camera to commence taking photographs for a fixed or variable time period, which are then compressed either within the digital camera or by the electronic control unit.

The electronic control unit also, upon detection of an intruder, commands the wireless telephone module with email multi-media messaging enabled to transmit these compressed digital photographs either per photograph or in varying batch quantities to pre-programmed addresses. It is noted that transmitting compressed digital photographs via email is in common place use.

The electronic control unit may also command a method of alerting the intruder to acknowledgment of the intruder's presence such as a local audio sound or message.

The electronic control unit is programmable with email addresses desired by the owner-operator to receive the compressed digital photographs. These addresses can include for the owner-operator, apprehending authority, insurance provider or others. Moreover, an address for a central control center can be programmed into the electronic control unit, thereby providing an independent receiver of these compressed digital photographs, with further capability of distributing them as desired.

The electronic control unit may also command the wireless telephone module to telephone pre-programmed telephone numbers such as the owner-operator, apprehending authority, insurance provider or others with a prerecorded message that the owner-operator personal space has been intruded upon. Or, the central control center may undertake to provide this service immediately upon receiving the initial photographs from the electronic control unit.

Notwithstanding the stand alone nature of this system, under certain circumstances it may be possible to add key features to other existing security systems, thereby improving their overall performance.

The foregoing is intended to be merely a summary, and not for limiting the scope of the present specification. The features of the invention that are believed to be novel are set forth with particularity in the claims. The invention, together with further objects and advantages thereof, may best be appreciated by reference to the following detailed description taken in conjunction with the drawing.

DETAILED DESCRIPTION OF THE INVENTION

Figure 1:
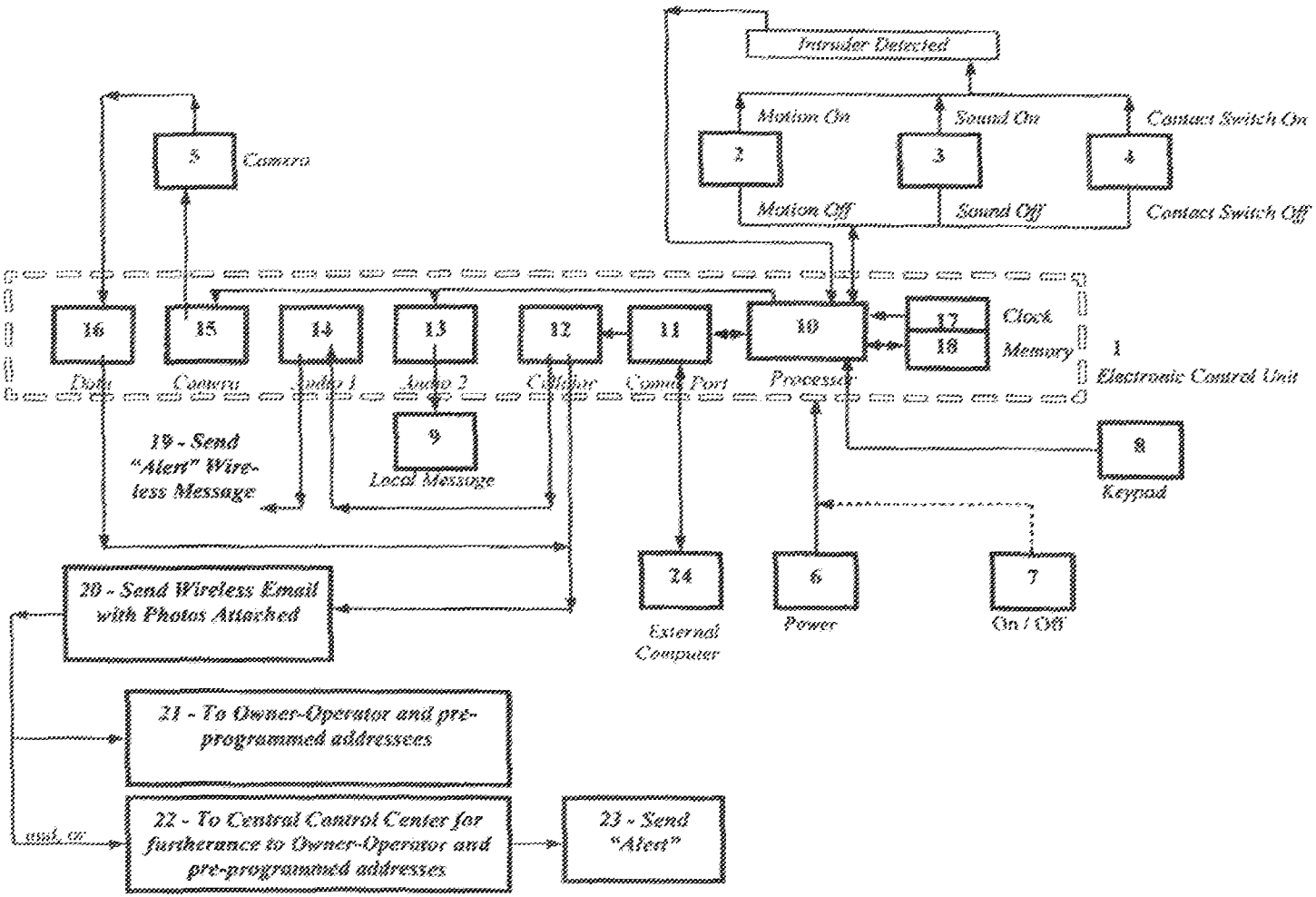
FIG. 1 illustrates an event based photo identification and alerting security system implementing the methods of the present invention.

Referring to FIG. 1, there is shown a novel event based photo identification and alerting security system of the present invention. While the present invention is susceptible to embodiments in various forms, there is provided detailed description of the presently preferred embodiments, with the understanding that the present disclosure is to be regarded as exemplifications, and does not limit the invention to the specific embodiments illustrated. In some instances, for purposes of explanation and not for limitation, specific numbers, diagrams, or dimensions, etc., may be set forth in order to provide a thorough understanding of the invention. In other instances, detailed descriptions of well known elements or electronic circuitry or computer/electronic Internet components are omitted so as to not obscure the depiction of the invention with unnecessary details.

Referring to FIG. 1, an event based photo identification and alerting security system may include an Electronic Control Unit 1, intrusion detection devices 2 and or 3 and or 4, a digital camera 5, and an email multimedia messaging service enabled 20, a power supply 6, an on-off switch 7, a programming keypad 8, a connection to an external computer 24, and an audio broadcast device 9 for the local environment.

Referring to FIG. 1, an electronic control unit 1 may include a microprocessor 10, a communication port 11, a cellular telephone module 12, an audio memory storage device 13, an audio memory storage device 14, a camera control command module 15, a data storage module 16, an outboard clock 17 and machine readable memory 18.

It is preferred when processor 10 is programmed to constantly monitor intrusion detecting devices, preferably motion sensors 2 and or sound sensors 3 and or contacts 4, although other means of detecting intrusion may also be used, provided they are able to be monitored by processor 10.

It is preferred when processor 10 detects a change in one or several of intrusion detecting devices 2 and or 3 and or 4, processor 10 commands camera control command module 15 to begin photographing through camera 5. Camera control command module 15 may be programmed to photograph through camera 5 at a varying rate and for varying time periods, however it is preferred that photographs be taken at rates from two per second to 10 per second and for durations up to 30 minutes, thereby providing maximum protection for the personal space. It is further preferred that the camera 5 be positioned to have within its field of vision the personal space desirable for protection against intrusion, thus capturing the intruder in the photographs. Furthermore, additional cameras 5 may be added to camera control command module 15 for the purposes of protecting multiple personal spaces against intrusion. It is also preferred that the immediate time and date be annotated on the photographs.

It is preferred photographs taken by camera 5 are compressed into. JPEG, GIF, etc. type formats and stored in data storage module 16. This compression may be accomplished in the camera control command module 15 or within the camera 5.

It is preferred additionally, when processor 10 detects a change in one or several of intrusion detecting devices 2 and or 3 and or 4, processor 10 commands communication port 11 to access cellular telephone module 12 and dial one or several pre-programmed telephone numbers.

It is preferred when cellular telephone module 12 establishes connection to the pre-programmed telephone number (s), an email multi-media messaging service enabled 20 transmits secure encrypted photographs, as is in common place use, to the pre-programmed recipient(s), either one at a time or in pre-determined batch sizes. Furthermore, once a photograph is transmitted to recipient(s), it is deleted from data storage module 16, thereby minimizing on board data storage capacity and size requirements of data storage module 16.

It is preferred additionally, when processor 10 detects a change in one or several of intrusion detecting devices 2 and or 3 and or 4, processor 10 may command audio memory storage device 13 to broadcast a local message or audible alarm thereby notifying the intruder of detection.

It is preferred additionally, cellular telephone module 12 may be pre-programmed to telephone a telephone number, either at the conclusion of sending photographs by email, or during a scheduled interruption, with a preprogrammed audio message stored in audio memory storage device 14 that may indicate to the recipient(s) the current intrusion incidence, time and date of intrusion.

It is preferred programming of telephone number(s) and email addresses may be facilitated through a keypad 8, or from external computer 11 through communication port 10.

It is preferred power 6 to the devices described may be provided by a low voltage cellular battery type device, rechargeable as needed, but may be any suitable source of power.

It is preferred an infra-red remote entry device is preferably used to operate the system from on to off and on again, but may be any suitable source of on-off activation.

The present invention is preferably a stand alone device, able to be designed and manufactured to be portable in an enclosure with dimensions approximating 5 inches by 7 inches by 1 inch and weighing less than 2 pounds. However, optimization of design and or component changes may reduce dimensions and weight. This portable device is highly suitable to protect and safeguard property, spaces and people from unwanted intrusions, theft, vandalism and other mischief while such property, spaces and people are mobile, and or for temporary protection, and or for supplemental protection to other existing security systems.

Certain key features of the present invention may be useful when combined with other installed or designed security systems, where redundancies in power supply, enclosure, motion and or sound and or electrical contacts are present.

A preferred installation for a motor vehicle security system could employ the present invention as a complete system. Alternately, an existing motor vehicle security system could be modified to include electronic control unit 1 and camera(s) 5 thereby enhancing the features and performance of the existing security system with event based photo identification and alerting.

A preferred installation for a residence, business or other commercial establishment could employ the present invention as a complete system. Alternately, an existing a residence, business or other commercial establishment security system could be modified to include electronic control unit 1 and camera(s) 5 thereby increasing the features and performance of the existing security system with event based photo identification and alerting.

Referring to [0027], a pre-programmed recipient of transmitted photographs may be a central control center 22. An advantage of central control center 22 is the immediate annotation with date and time and electronic archival using a secure encrypted protocol. The central control center 22 may further relay secure encrypted photographs to desired recipients, by wireless or wire based modes and undertake the sending of an alert message to the owner-operator or additional recipients by wireless or wire based modes.

The portable event based photo identification and alerting system of the present invention is, therefore, ideally suited for mobile protection of property, spaces and people, and for protection in motor vehicles, residences, businesses and other commercial locations, either as a stand alone system or as an addition in whole or in part to existing security systems. As has been emphasized, when an intruder enters into personal spaces, detection devices determine the intruder's presence and digital photographs are immediately taken, and securely transmitted to predetermined recipients that may include an owner-operator, apprehending authorities or others. Time and date are annotated to these photographs. Furthermore, an audio message is sent to the owner-operator, apprehending authorities or others that the intrusion is occurring, also annotating this information with time and date, thus enabling an opportunity to respond immediately to the intrusion. If desired, a local audio message at the intrusion location may announce to the intruder that detection has been made and or that photographs have already been taken and securely transmitted.

Naturally, the embodiments of the event based photo identification and alerting system of the present invention are not limited to the above-described examples or to those examples shown in the drawing. It will be understood that various substitutions, rearrangements and other changes to the forms and details of the examples can be made by those skilled in the art without departing from the scope of the invention as set forth in the annexed claims.

What is claimed is:

1. A method for providing portable instantaneous wireless event based photo identification and alerting comprising:

detecting, by at least one sensor, an intrusion;

capturing a still image photograph of the intrusion by using a digital camera responsive to detecting the intrusion;

compressing the still image photograph to form a compressed format file;

encrypting the compressed format file at a location where said still image photograph was captured;

communicating, by a portable wireless device, an electronic mail message having attached the compressed and encrypted format file, the electronic mail message indicating detection of the intrusion to at least one of a person or a device;

persisting, at a remote location with respect to said intrusion, the electronic mail message containing said still image photograph, for retrieval at a later time; and thereby providing instantaneous wireless event based photo identification and alerting.

2. The method according to claim 1 wherein communicating said electronic message further includes:

transmitting said electronic message to a central control center that archives said at photograph, wherein said central control center is remotely located with respect to said intrusion.

3. The method according to claim 2 wherein transmitting said electronic message to a remote location farther includes:

identifying one or more crime perpetrators to said central control center, wherein said crime perpetrators are responsible for causing said intrusion.

4. The method according to claim 1 wherein:

detecting said intrusion further includes determining an intruder's presence inside a motor vehicle by at least one of a motion detector, a sound detector and an electrical contacts disturbance; and wherein taking at least one picture of an intruder responsive to detecting the intrusion further includes taking one or more digital photographs of the inside of said motor vehicle; and wherein communicating, by a portable wireless device, an electronic message farther includes emailing said at least one picture to a remote user selected email address and instantly telephoning a user selected number including at least one of: a cellular number, a home number and a pager number with a pre-recorded alert message.

5. An apparatus for providing portable instantaneous wireless event based photo identification and alerting comprising:

a sensor means for detecting an intrusion;

a camera means for capturing a still image photograph of the intrusion responsive to detecting the intrusion;

a compression means for forming a compressed format version of the still image photograph;

an encryption module for encrypting the compressed format file at a location where said still image photograph was captured;

a portable wireless means for communicating an electronic message including the compressed format version of the picture, the electronic message indicating detection of the intrusion to at least one of a person or a device; and a storage means for persisting, at a remote location with respect to said intrusion, the electronic mail message containing said still image photograph, for retrieval at a later time;

thereby providing instantaneous wireless event based photo identification and alerting.

6. A method for providing portable instantaneous wireless event based photo identification and alerting, said method comprising:

monitoring a local environment and one or more preset conditions for any changes by at least one central processing unit (CPU);

detecting one or more changes to said preset conditions by said CPU and commanding at least one digital camera to commence at least one still image digital photograph of said local environment in response to detection of said changes to said preset conditions;

storing said still image digital photograph in a data storage module;

annotating said still image digital photograph with at least one of a date and a time and compressing said still image digital photograph to form a compressed format file;

encrypting the still image digital photograph at the local environment where the still image digital photograph was captured;

transmitting, via wireless communication, an electronic message that indicates detection of said changes to said preset conditions, to a pre-programmed address, said electronic message including the annotated and compressed digital photographs; and persisting, at a remote location with respect to said local environment, the electronic message containing said still image digital photograph, for retrieval at a later time.

7. The method according to claim 6 wherein monitoring said local environment includes monitoring at least one of: a motor vehicle, a residence, a business and a commercial location.

8. The method according to claim 6 wherein transmitting, via wireless communication, said electronic message that indicates detection of said changes to said preset conditions to a pre-programmed address further includes:

transmitting said electronic message to a central control center that archives said digital photographs, said central control center being remotely located with respect to said local environment; and relaying, by said central control center, copies of said digital photographs to one or more pre-programmed recipients using a secure encryption.

9. The method according to claim 8 wherein transmitting said electronic message to a central control center further includes:

identifying one or more crime perpetrators to said central control center, wherein said crime perpetrators are responsible for said changes to said preset conditions.

10. The method according to claim 6, further comprising:

playing, upon detection of said changes to said preset conditions, at least one of a pre-recorded audio message and an alarm sound proximate to said local environment in order to alert that a change in said preset conditions has occurred.

11. The method according to claim 6 wherein:

detecting one or more changes to said preset conditions by said CPU further includes determining, by said CPU, an intruder's presence inside a motor vehicle; and wherein taking said digital photographs of said local environment further includes taking digital photographs of the inside of said motor vehicle; and wherein transmitting, via wireless communication, an electronic message that indicates detection of said changes to said preset conditions further includes emailing said photographs to a remote user selected email address and telephoning a user selected number including at least one of a cellular number, a home number and a pager number with a pre-recorded alert message.

12. The method according to claim 6 wherein transmitting said electronic message further includes:

transmitting, via wireless technology, a pre-recorded audio message annotated with a time and date to a central control center that archives the message and relays the message to a pre-programmed recipient.

13. The method according to claim 6 wherein detecting one or more changes to said preset conditions by said CPU further includes:

detecting at least one of a motion, a sound and an electrical contacts disturbance made by an intruder entering said local environment.

14. The method according to claim 8 further comprising:

deleting said digital photographs from said data storage module after having transmitted said digital photographs to said pre-programmed address in order to minimize on board data storage capacity and size requirements of said data storage module.

* * * * *